United States Patent [19]

Nentwig

[11] 4,445,311

[45] May 1, 1984

[54] PORTIONING AND PACKING MACHINE

[75] Inventor: Jürgen Nentwig, Vienna, Austria

[73] Assignee: Asto Import- und Exportgesellschaft M.B.H. & Co. Kg., Vienna, Austria

[21] Appl. No.: 343,268

[22] Filed: Jan. 27, 1982

[51] Int. Cl.[3] ..... B65B 49/08; B65B 11/40

[52] U.S. Cl. ..... 53/575; 53/577; 53/221; 141/114

[58] Field of Search ..... 53/575, 577, 579, 221, 53/225, 266 R; 141/114, 313

[56] References Cited

U.S. PATENT DOCUMENTS

| | | | |
|---|---|---|---|
| 2,009,416 | 7/1935 | Schilder | 53/575 |
| 2,179,742 | 11/1939 | Heres | 53/577 |
| 2,718,701 | 9/1955 | Fromwiller | 53/575 X |
| 3,146,565 | 9/1964 | Otto | 53/575 |
| 3,306,002 | 2/1967 | Vogt | 53/575 X |
| 3,533,207 | 10/1970 | Freemantle et al. | 53/222 X |
| 4,147,014 | 4/1979 | Tashiro et al. | 53/575 X |

*Primary Examiner*—Horace M. Culver
*Attorney, Agent, or Firm*—Karl F. Ross; Herbert Dubno

[57] ABSTRACT

A portioning and packaging machine for pasty materials, especially food products such as butter, margarine and cheese, comprises a stationary feed tube around which a portioning head is rotated. The portioning head is formed with radial portioning cylinders receiving the material from the feed tube and pistons which are displaceable relative to the cylinders for driving the material into vertical filling tubes. The filling tubes are raised and lowered with respect to the head by a stationary cam arrangement which can also include a cam for raising and lowering a sleeve forming a packaging foil or sheet into a cup adapted to receive the portion. The sleeve picks up the sheet from a table rotating with the head and forms the cup which it carries into a cavity of a forming table in which the portion is deposited in the resulting cup.

6 Claims, 3 Drawing Figures

PORTIONING AND PACKING MACHINE

FIELD OF THE INVENTION

My present invention relates to a packaging and portioning machine and, more particularly, to an apparatus for forming portions of a pasty material substance, especially a food product such as a dairy product, and packaging the same.

BACKGROUND OF THE INVENTION

Various pasty comestibles, especially dairy products, are marketed in cup-shaped portions or packages of predetermined volume or weight on a large scale so that machines for portioning and packaging such pasty materials are required.

Such machines can be used for the portioning of butter, margarine, cheeses and like substances which can be produced in a pasty form and which are to be distributed in packaged portions.

The term "packaged" is here intended to refer to any enclosure for the comestible substance and can be a foil, sheet or laminate layer which forms a one-piece or multi-part enclosure.

A one-piece enclosure, for example, may wrap the portion in a foil of metal (aluminum foil) or a synthetic resin material or even a cellulosic (such as paper) layer. Multi-part packages may include a cup of a somewhat stiffer material to which a cover may be applied. Multi-part packages also can include multi-layer foils which are sealed together.

Earlier machines for the portioning and packaging of pasty materials, especially butter, margarine and the like, have comprised a feed tube around which the filling head and, synchronously with the latter, a carrier for the packaging to be filled, were rotated. The filling head or a member thereof was lowered into the packaging, e.g., in the form of a vertically displaceable filling tube and the up-and-down movement of the latter was controlled by a cam arrangement.

This movement deposited a predetermined portion of the pasty material in the packaging at a predetermined station along the path of the latter and the packaged portion was thereafter removed at a subsequent station.

An apparatus for this purpose and of this type was described, for example, in British Pat. No. 1,079,526 and served for the packaging of molten cheese.

In this device, an extension of a supply vessel for the pasty material was surrounded by a metering head rotatable about a vertical axis and carrying an axially shiftable cam-controlled filling tube provided on its lower end with a nozzle insertable in a preformed package coupled with the metering head by a chain.

The tube was formed with a piston, also operated by cam means, with the movements of cylinder and piston so controlled that a predetermined portion of the product was introduced into the package and was forced out of the tube in a lowered position of the latter.

To prevent undesired passage of the material out of the filling tube, special slide valves were provided above the nozzle, also under cam control.

This machine was extremely complex, difficult to regulate and adjust and unreliable, especially with respect to the timing of the filling process. Difficulties were encountered in efforts to coordinate this machine with the machines for forming the package. Obviously this system was not operative at all in the case in which the package was not preformed.

It is also known to provide metering and packaging devices (see U.S. Pat. No. 4,060,109) in which the metering is effected by cam-controlld pistons in filling tubes.

I am not aware, however, that any of these earlier systems have been fully effective when simultaneous portioning and packaging of the pasty products was required.

OBJECTS OF THE INVENTION

It is the principal object of the present invention to provide an improved metering and portioning device for the purposes described and whereby the aforementioned disadvantages are obviated.

Another object of this invention is to provide a portioning and packaging machine for pasty materials, especially dairy products, which allows the simultaneous formation of the package and introduction of a portion of the product therein, while simplifying the adjustment and reliability of the machine.

SUMMARY OF THE INVENTION

These objects and others which will become apparent hereinafter are attained, in accordance with the present invention, in an apparatus for the portioning and packaging of pasty materials, especially dairy products such as butter, margarine and the like, wherein the material is fed continuously to a supply tube which advantageously is vertically disposed and stationary, and around which the filling head is rotatable. According to the invention, synchronously rotatable with the filling head, I provide a carrier for the packaging material, this carrier also being rotatable about the supply tube, the filling head being formed with substantially vertically disposed filling tubes which are vertically displaceable under the control of a fixed cam upon which the cam followers of the filling tubes ride.

In order to eliminate the disadvantages of the earlier systems and enable precise metering of the product, the present invention provides that in the filling head itself, respective metering cylinders are provided for each of the filling tubes, these metering cylinders having pistons which are controlled by a cam which is fixed to the supply tube but can be angularly adjusted relative thereto for timing purposes.

These metering cylinders are disposed preferably substantially radially in the metering head and can communicate substantially radially with the supply tube, while having lateral openings communicating with respective filling tubes.

The latter openings can communicate with the filling tubes over elongated windows formed in the walls thereof and dimensioned to allow communication during at least a predetermined part of the rotational path of the dosing head.

The communication between the supply tube and each cylinder is effected over a portion of the angular displacement of the dosing head.

Thus each metering cylinder is connected to the supply tube for only a portion of its angular displacement around the latter and the displacement of the material from the feed tube is effected by the piston in the metering cylinder.

The apparatus also comprises a table upon which the packaging material is placed, this table being disposed between the metering head and the forming table and enabling the packaging material to be entrained through a respective opening on the packaging material table into the shaping cavity in the forming table for deposition of the portion.

The cam controlling the vertical displacement of the filling tube is angularly adjustable on the supply tube and can be locked at a predetermined or selected position thereon.

According to another feature of the invention, the intermittently opening and closing passage between each metering cylinder and the supply tube can be formed by providing an elongated slot in the supply tube extending, for example, over an angular extent of 180°. The alternately openable and closeable communication between each metering cylinder and the respective filling tube can be made by forming a vertically elongated longitudinally extending window in the latter which can be moved past a bore communicating with the metering cylinder.

It has been found to be advantageous to form the packaging material into the configuration of a cup or sack prior to the deposition of the portion therein.

In this case, the machine advantageously comprises a sleeve which is capable of surrounding the discharge end of the filling tube with clearance and which can be inserted into the cavity of the forming table, preferably after passing through an aligned passage of the layer-receiving table.

This sleeve, which can be controlled by a stationary cam carried by the supply tube and can be coaxial with the filling tube, thus serves to entrain the flat foil or other sheet material through the passage of the other table and into the cavity of the forming table. The latter cavity may also be provided with an ejector for lifting the packaged portion from the latter table.

Upon retraction of this sleeve, of course, the packaging material is retained in the cavity and has the formation of a cup or bag, preferably with an outwardly bent edge portion adapted to be folded over the portion which has been deposited in the cup or bag.

The ejector can, of course, be controlled by a stationary cam as well.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
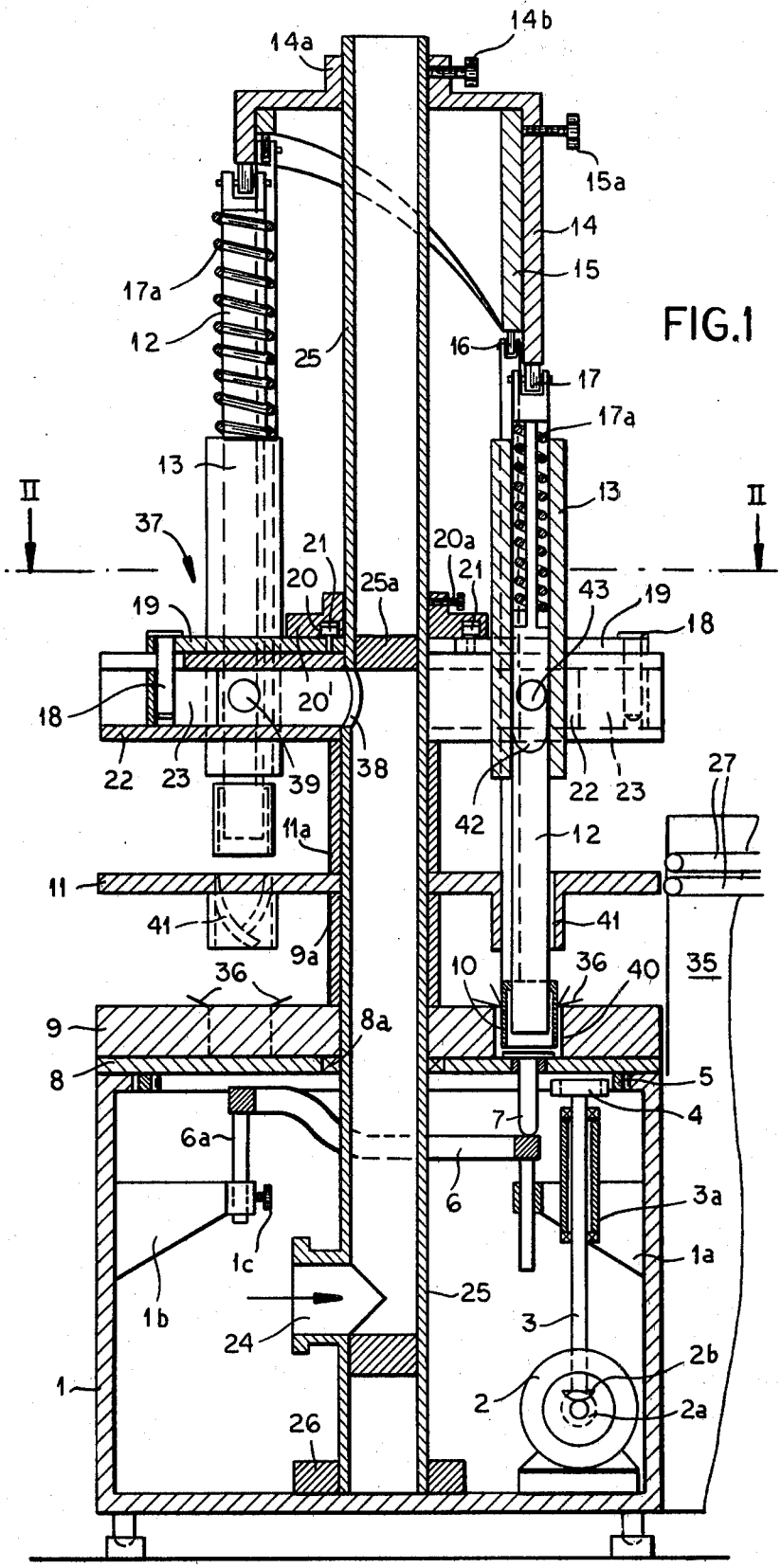
FIG. 1 is a diagrammatical vertical section of a machine embodying the present invention.
Figure 2:
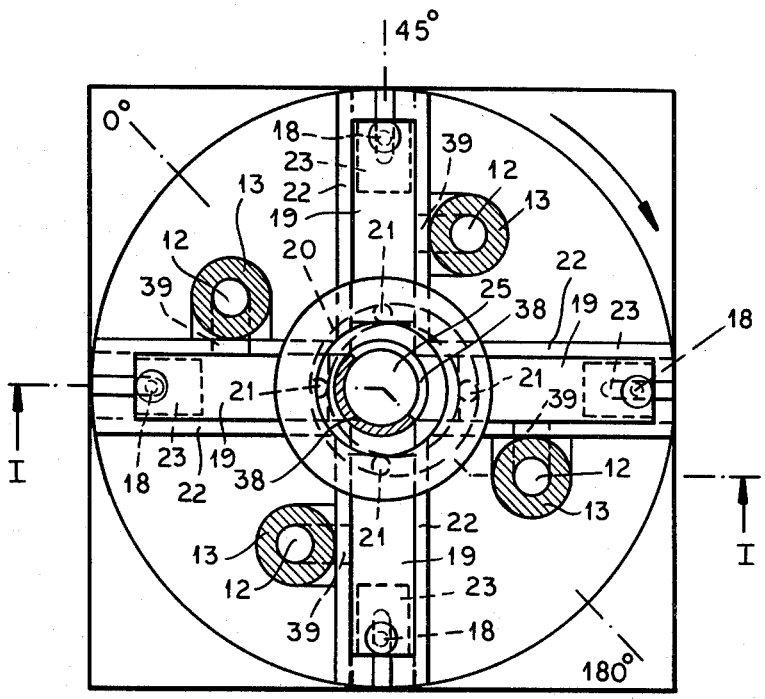
FIG. 2 is a section taken along the line II—II of FIG. 1.

The apparatus shown in FIGS. 1 and 2 comprises a machine support 1 provided with a drive motor 2 connected by gearing 2*a*, 2*b* to a shaft 3 journaled in a bearing 3*a* carried by a bracket 1*a* and driving a pinion gear 4 which meshes with a ring gear 5 mounted on a plate 8 which is journaled by a bearing 8*a* about a stationary supply tube 25 extending vertically and fixed at its lower end by a ring 26 to the housing 1 of the machine.

The supply tube 25 is connected by a flange 24 to a feeder, e.g. a worm conveyor, supplying the pasty material to be packaged in portions, e.g. butter, margarine, cheese or the like.

The brackets 1*a* and 1*b* also have sleeves receiving the rods 6*a* of a cam 6 whose function will be described in greater detail hereinafter and which can be vertically adjusted via setscrews as shown at 1*c*.

At its upper end, the stationary supply tube 25 is provided with an outer cam 14 whose sleeves 14*a* can be locked to the tube 25 which is closed at 25*a*, via setscrew 14*b*. This permits adjustment of the angular position of the cam 14 with respect to the supply tube 25 as well as setting of the relative axial positions of these members.

Within the cam 14, a further stationary cam 15 is provided, the angular position and axial position of this cam relative to the cam 14 and hence to the tube 25 being fixed by setscrew 15*a*.

A metering head 37 is rotatable around the stationary tube 25.

Rotational coupling between the gear 5 and this head 37 is effected via the tables 9 and 11 and the sleeves 9*a* and 11*a*, welded to these tables and to the head 37.

The metering head 37 comprises four angularly equispaced radial metering cylinders 22 which communicate, successively, with an opening 38 in the supply tube 25, this opening 38 being a slot-shaped window angularly extending through 180° about the axis (see FIG. 2) so that the pasty material can flow from the tube 25 to the metering cylinders.

Each of the metering cylinders 22 is provided with a slideable piston 23 which, being rotatably entrained with the head 37, is radially displaced by a cam 20.

The cam 20 is a slave cam formed in the disk 20′ which is fixed to the tube 25 by a setscrew 20*a* so that the angular position of the cam 20 relative to the slot 38 can be adjusted with ease.

When the setscrew 20*a* is loosened, therefore, the disk 20′ can be angularly displaced about the tube 25.

The adjustability of the disk about the tube 25 permits the beginning and end of each stroke relative to the opening 38 to be selected.

A cam follower roller 21 rides along cam 20 and is connected by a link 19 and an entraining pin 18 with the piston 23.

The wall of each metering cylinder 22 is provided with an opening which communicates with a passage 39 of a filling tube 12 vertically displaceable in a guide sleeve 13.

Each filling tube is thus displaceable up and down in the guide sleeve 13 and is biased completely by a spring 17*a*.

Along the periphery of each filling tube 12, an elongated window 42 is provided so that this window communicates with an opening 43 in the guide 13 and via the opening 43 with a passage 39 of the metering cylinder 22 so that the material displaced by the respective piston 23 is forced laterally from the respective metering cylinder into the respective filling tube 12.

Since the passages 42 and 43 disalign in some positions of the filling tube 12, the maximum amount of material which can be fed through the filling tube 12 depends upon the stroke of the piston 23 and of the filling tube 12.

The filling tube 12 is vertically shifted by the cam 14. More particularly, a cam-follower roller 17 of each filling tube 12 rides along the cam 14 and is urged thereagainst by the spring 17*a*. Since the cam 14 can be angularly displaced and adjusted relative to the tube 25, the position of the cam 14 can control the timing of coincidence between the openings 42 and 43.

As already noted, a table 11 is angularly displaceable with the head 37 around the supply tube 25.

Below this table 11 is the forming table 9 which is also coupled with the table 11 and together with the latter is driven with the head 37 around the supply tube 25.

The forming table 9 is provided with cavities or recesses 40, equal in number to the number of metering cylinders 22, each of the cavities 40 being aligned with a respective filling tube 12.

The lower ends 12 of the filling tubes are surrounded by respective sleeves 10 which are vertically displaceable under the control of a cam 15 previously described and are coupled with respective cam followers 16 via rods 16*a* which can be springbiased against the cam as described for the feed tubes 12.

The table 11 is provided with passages 41 which are aligned with cavities 40 and receive the sleeves 10 with clearance.

Sheets of wrapping foil are fed through the table 11 and are disposed over the passages 41 thereof. As the sleeve 10 and filling tube 12 are lowered through the respective passage 41 they entrain the packaging material and impart a cup shape to the latter as can be seen from FIG. 1. The resulting cup, with flaps 36 overhanging the edge of the cavity 40, is carried into the latter and the sleeve 10 retraced. With retraction of the tube 12, the pasty material is deposited in a predetermined portion size in the package and, as the tables and head rotate, the flaps 36 may be closed and the packaged portion lifted by ejector 7 from the cavity 40. The ejector 7 lifts the bottom plate 44 of the cavity and the package can be deposited upon a lateral conveyor and carried away for insertion into cartons or the like.

Figure 3:
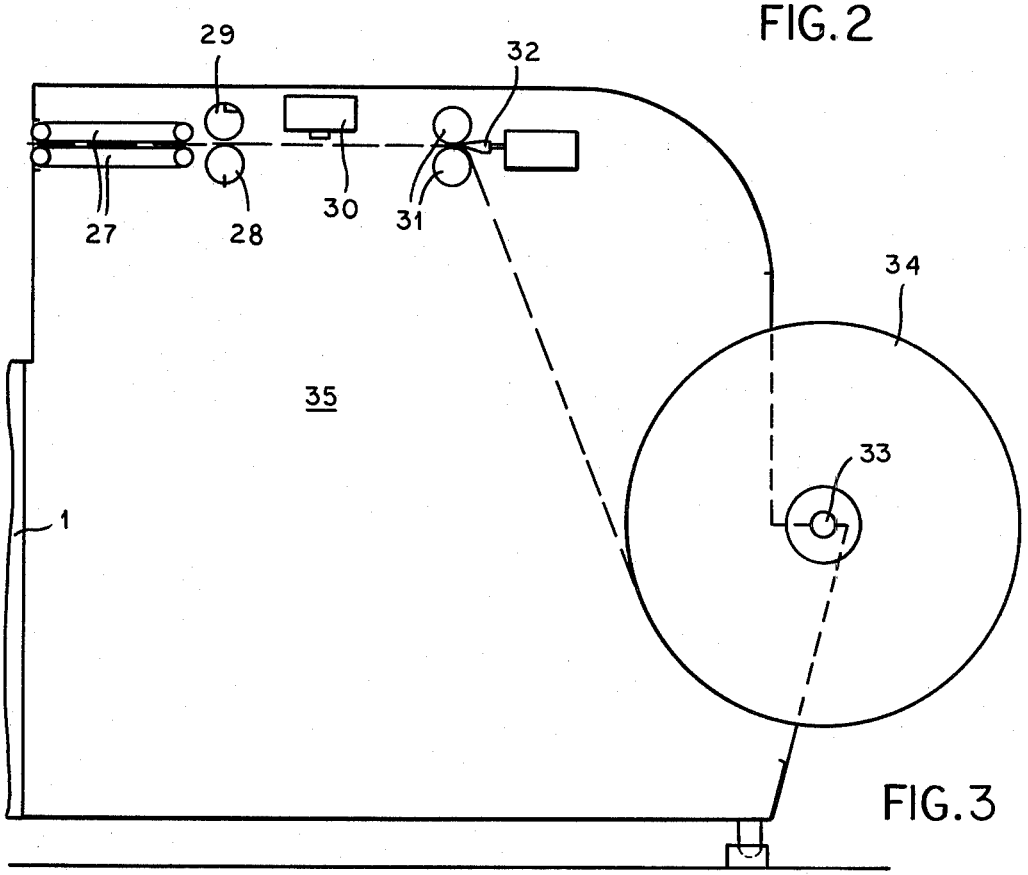
FIG. 3 is a diagrammatical elevational view showing a machine for feeding the sheet-shaped packaging material to the table of the apparatus of FIGS. 1 and 2.

FIG. 3 shows a unit for feeding the packaging foils to the table 11.

The packaging material is delivered by a supply roll 34 to a pair of feed rollers 31 before passing under a photocell 30. The photocell 30 enters the sheet material in the device and controls a wedge 32 adapted to be inserted into the nip between the rollers 31 to block further extraction of material from the roll 34. The foil then passes between a pair of cutting rollers 28, 29 which separates the foil into sheets which are carried by the conveyors 27 onto the table 11.

The apparatus thus described thus forms a sheet-forming unit 35 feeding the portioning and packaging machine.

When foil centering automatically is not desireable, it is merely necessary to insure synchronism of the roller pairs 28, 29 and 31, the photocell 30 and the control wedge 32 being eliminated.

A mechanical marking or printing device can be used to stamp, and emboss and perforate or otherwise impart indicia to the packaging material, e.g. to apply a packaging date. Such means can be provided between the photocells 30 and the rollers 31 above a printing table which may be introduced for this purpose.

Other control means can be provided, e.g. along the path of the packaging material between supply roll 34 and its journaling axis 33, and the feed rollers 31, to detect the end of the packaging material or another failure. This means can include a switch or relay for cutting of the drive motor 2.

In the 0° position shown in FIG. 2, the metering piston 23 begins its outward movement as is determined by the cam 20 as the head 37 is rotated about the axis of the stationary tube 25. Since in this position the tube 25 opens into the metering cylinder 22 via slot 38, the piston 23 draws the pasty material into the metering cylinder.

Since the slot 38 extends over 180°, two metering cylinders 22 are always being filled simultaneously.

During the angular displacement between 30° and 45°, a sheet of the packaging material is delivered by the conveyors 27 to the table 11. In the next portion of the displacement of the head 27, i.e. between 45° and 180°, the sleeve 10 is displaced downwardly by stationary cam 15 and forces the sheet through the passage 41 in the table 11 to form a bag or cup in the cavity 40 of the table 9.

The filling tube 12 is displaced downwardly as well and as soon as the filling tube 12 has reached its lower dead point, the opening 42 registers with the opening 43 and during the further movement of the head 37, the piston 23 drives the product through the tube 12 into the cavity and the bag formed therein as the filling tube 12 rises. At 270°, the filling process is terminated and communication between passages 42 and 43 is blocked, whereupon the foils 36 are closed over the portion and the package lifted from the cavity 40 in the ensuing 90°.

Sterilization and cleaning can be effected, after mechanical removal of the pasty mass from the feed tube 25, the cylinders 22 and the filling tubes 12, by forcing a cleaning agent through this system by connecting a supply line for the latter at the flange 24.

I claim:

1. A portioning and packaging apparatus for a pasty substance, comprising:

a vertically extending feed tube continuously supplied with said pasty substance;

a metering head rotatable around said feed tube and formed with a plurality of angularly spaced generally radially extending metering cylinders communicating with said feed tube only over a portion of the angular displacement of said head about said feed tube, and respective pistons displaceable in said cylinders for metering said substance therefrom, said head being provided with a respective filling tube communicating laterally with each of said cylinders and vertically displaceable on said head;

a forming table rotatable about the axis of said feeding tube and formed with a plurality of forming cavities each aligned with a respective one of said filling tubes;

a layer-receiving table between said forming table and said head and rotatable with said head about said axis, said forming table being provided with a plurality of passages each aligned with the respective one of said cavities whereby respective layers of wrapping material can be applied to said layer-receiving table over a respective passage therein for entrainment into a respective cavity to form a package;

first cam means on said feeding tube operatively connected to said pistons for controlling the displacement thereof during rotation of said head; and second cam means fixed to said feeding tube for controlling the vertical displacement of said filling tubes whereby said filling tubes deposite said substance in said packages in said cavities.

2. The apparatus defined in claim 1, further comprising means for angularly adjusting said second cam means about said axis relative to said feeding tube.

3. The apparatus defined in claim 2, further comprising means for angularly adjusting said first cam means about said axis relative to said feeding tube.

4. The apparatus defined in claim 3 wherein each of said filling tubes is formed with an elongated window communicating with the respective metering cylinder over only a portion of the axial vertical displacement of filling tube by said second cam means.

5. The apparatus defined in claim 4 wherein a respective sleeve surrounds each of said filling tubes, said apparatus further comprising third cam means fixed relative to said feeding tube for displacing each sleeve through the respective passage in said layer-receiving table to form the respective package in a respective cavity of said forming table.

6. The apparatus defined in claim 5, further comprising ejector means in each cavity operable upon rotation of said forming table for lifting the respective package from the respective cavity.

* * * * *